United States Patent [19]

Sinsley

[11] 4,233,692

[45] Nov. 18, 1980

[54] REST ROOMS

[76] Inventor: John D. Sinsley, 509 Sugar Camp Dr., East Palestine, Ohio 44413

[21] Appl. No.: 82,736

[22] Filed: Oct. 9, 1979

Related U.S. Application Data

[63] Continuation of Ser. No. 917,192, Jun. 20, 1978, abandoned.

[51] Int. Cl.[3] ..... A47K 17/00

[52] U.S. Cl. ..... 4/662; 4/664; 52/34

[58] Field of Search ..... 4/1, 2, 252, 145, 146

[56] References Cited

U.S. PATENT DOCUMENTS

| | | | |
|---|---|---|---|
| 2,486,371 | 10/1949 | Mankki | 4/2 |
| 2,557,470 | 6/1951 | Rollie et al. | 4/2 |
| 3,015,110 | 1/1962 | Treand | 4/2 |
| 3,110,907 | 11/1963 | King | 4/2 |
| 3,713,176 | 1/1973 | Stock | 4/1 |
| 3,742,520 | 7/1973 | Bernardi | 4/1 |
| 3,747,129 | 7/1973 | Dyar | 4/1 |
| 3,755,826 | 9/1973 | Robert | 4/1 |
| 3,837,011 | 9/1974 | McTighe et al. | 4/1 |
| 3,905,048 | 9/1975 | Moller | 4/2 |

*Primary Examiner*—Henry K. Artis

*Attorney, Agent, or Firm*—Buell, Blenko, Ziesenheim & Beck

[57] ABSTRACT

A rest room module adapted for rapid, efficient and thorough manual or automatic cleaning is provided having a unitary floor, ceiling and four walls, an entrance in one of said walls, a sealable closure for said entrance, a drain opening in said floor, lighting means sealingly recessed in one of said walls and/or ceiling, a toilet fixture positioned between two of said walls and forming an integral part thereof, and a lavatory and counter fixture on at least one wall adjacent said toilet and forming an integral part of said wall, and one of a urinal fixture and counter on the other wall adjacent to said toilet and forming an integral part of said wall, said wall and fixtures being an integral unitary assembly with all intersecting surfaces being arcuately contoured.

6 Claims, 6 Drawing Figures

REST ROOMS

This application is a continuation of my co-pending application Ser. No. 917,192, filed June 20, 1978, now abandoned.

This invention relates to rest rooms and particularly to a public rest room or toilet which may be readily cleaned or self cleaning.

Public rest rooms or toilets are a very great problem both to the public who use them and the proprietor who maintains them. The generally unsightly and unsanitary public rest rooms which the travelling public is forced to use are very well known. The problem is based in part upon the carelessness of the public and in part upon the difficulty of obtaining competent workers to manually clean such rest rooms. Unfortunately, there appears to be no solution to public carelessness and with the present economic and social climate very little solution to the problem of obtaining competent workers.

There have been attempts to solve the problem of cleanliness of public rest rooms by a great variety of self-cleaning rest room arrangements. For example, U.S. Pat. No. 3,381,312 provides cleaning implements in the ceiling which are automatically lowered to wash and rinse the toilet facilities, followed by a vacuum system for removing water and a drying system for drying. The balance of the rest room remained uncleaned. U.S. Pat. No. 3,713,176 provides rest room facilities having a movable panel which carries a mirror, a hand towel dispenser, toilet tissue dispenser and like articles which may be damaged by cleaning fluids. This panel is movable from a normally vertical to a horizontal position where after the room may be sprayed with fluid from nozzles and then dried with forced air. U.S. Pat. No. 3,720,961 provides a structure in which two side wall portions are movable around vertical hinges to form a small enclosure into which cleaning fluids are sprayed and then removed. U.S. Pat. No. 3,742,520 provides a rest room in which cleaning fluids are simply sequentially sprayed at intervals with cleaning and drying fluids. U.S. Pat. No. 3,747,129 is another arrangement for spraying cleaning fluids and drying air sequentially into the room. U.S. Pat. No. 3,755,826 is still another arrangement for simply spraying an entire room area from ceiling nozzles followed by drying from the ceiling. U.S. Pat. No. 3,837,011 provides a circular structure with the fixtures in the center and a traveling spray moving around the wall. Finally, U.S. Pat. No. 3,869,732 is simply a modification of U.S. Pat. No. 3,720,961 in which two wall segments pivot transverse to the third to form a reduced enclosure into which cleaning and drying fluids are sprayed. In all cases the structures are based upon the use of conventional wall hung and floor mounted fixtures with the usual joints, cracks and hollow places for the collection of bacteria, dirt and debris. In addition, most of the devices of the prior art depend upon ceiling mounted nozzles for cleaning. As a result cleaning fluid which reaches the floor has lost much of its washing power.

I provide a novel rest room structure which may be readily and quickly manually cleaned or self cleaned. It is a simple, uncomplicated structure which may take either a manual cleaning or an automatic cleaning format.

Preferably I provide a unitary pre-assembled watertight rest room module, having four walls, a floor and a ceiling, an entrance in one of said walls, a sealable closure for said entrance, a drain opening, lighting means sealingly recessed in one of said walls and ceiling, a toilet fixture positioned between two walls and enclosed integrally therewith, a lavatory and counter on at least one wall adjacent said toilet and integral with said wall, and a urinal or counter on the other adjacent wall and integral therewith, said walls and fixtures being an integral assembly with all intersections being arcuately contoured. Preferably a plurality of nozzles are provided in each wall directing a stream of cleaning fluid across each of the toilet fixture, the lavatory and counter, the urinal and the floor. Preferably detergent, disinfectant and wetting agent reservoirs are provided on the back side of one wall, along with the piping connections from each of the fixtures within the unit and a pump may be provided for increasing the fluid pressure. Blower means are preferably provided on the back side of one wall delivering heated air for drying and vent means are provided for removing the drying air. A warm air hand dryer is provided in a wall adjacent the toilet fixture. The paper dispenser and optionally the hand dryer are preferably provided with sealing closures during cleaning. Preferably the entire assembly of walls, ceiling, floor and fixtures are formed as a single unitary assembly of reenforced plastics such as fiberglass reenforced polyester resin. However the walls may be molded around ceramic fixtures or the entire assembly may be of ceramic or of ceramic coated metal. The rest room of this invention is preferably generally square or rectangular in floor plan with the toilet fixture in one corner, the lavatory and counter in one adjacent corner and the urinal in the adjacent corner opposite the lavatory. Preferably the nozzles sequentially direct washing fluid, sanitizing fluid and then rinsing fluid, followed by drying fluid such as air. A control system is preferably provided on one wall adjacent the entrance, outside the rest room for operating the delivery of fluid to the nozzles. A safety interlock between the control system and entrance closure is provided to prevent opening the closure when the nozzles are in operation and/or preventing operation of the nozzles when the entrance closure is open.

In the foregoing general description I have set out certain objects, purposes and advantages of this invention. Other objects, purposes and advantages of this invention will be apparent from a consideration of the following description and the accompanying drawings in which.

Figure 1:
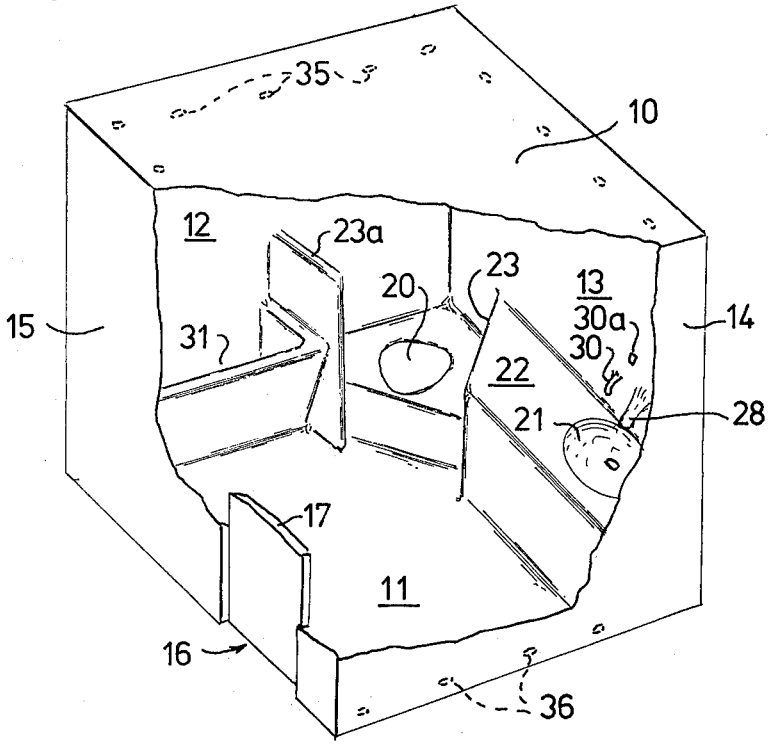
FIG. 1 is an isometric view, partly broken away, of a rest room according to this invention.
Figure 2:
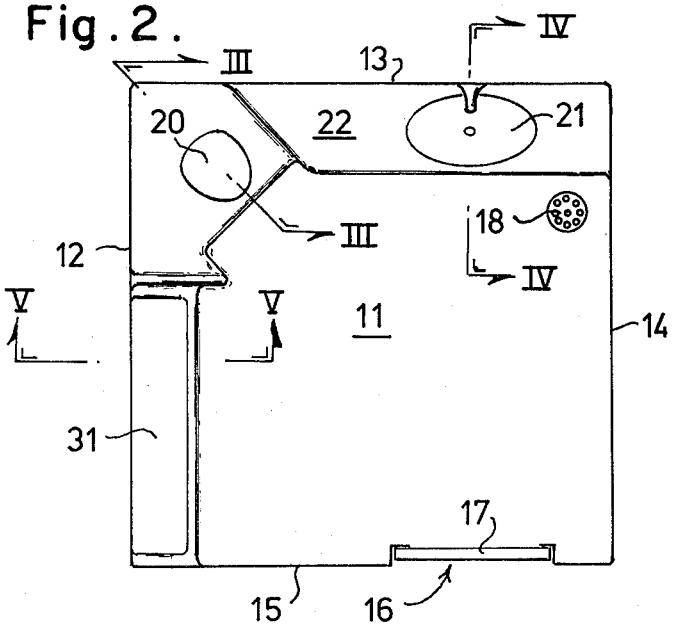
FIG. 2 is a top plan view of the rest room of FIG. 1 with the ceiling removed.
Figure 3:
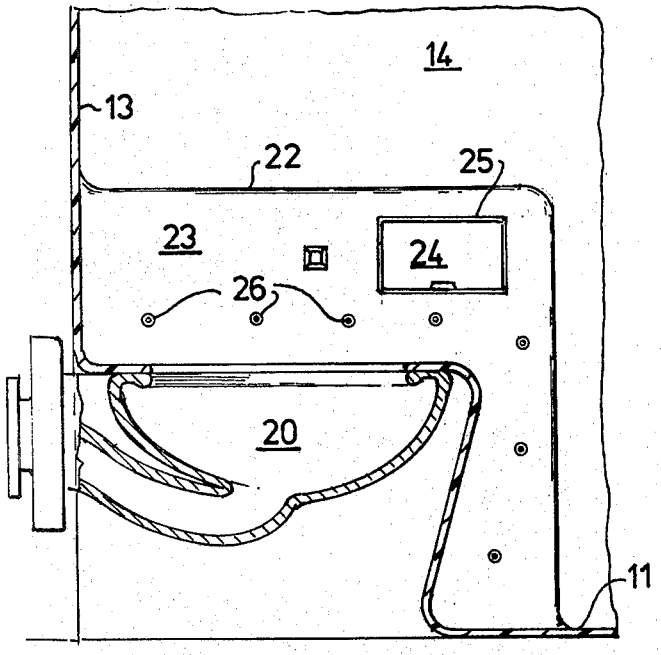
FIG. 3 is a fragmentary section on the line III—III of FIG. 2.
Figure 4:
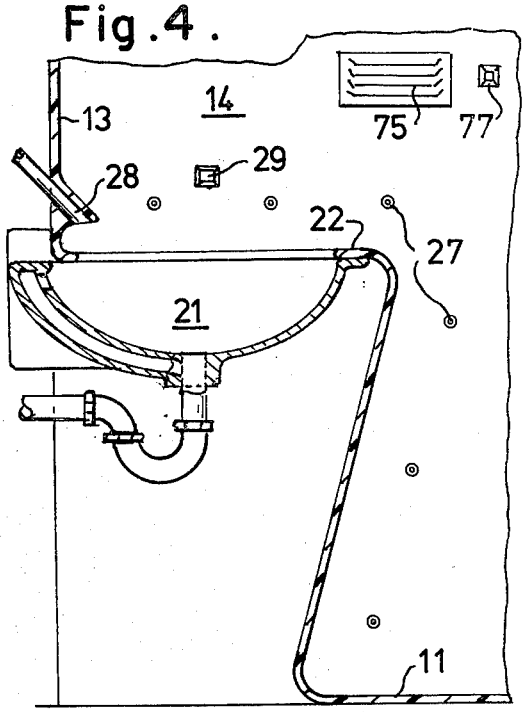
FIG. 4 is a fragmentary section on the line IV—IV of FIG. 2.
Figure 5:
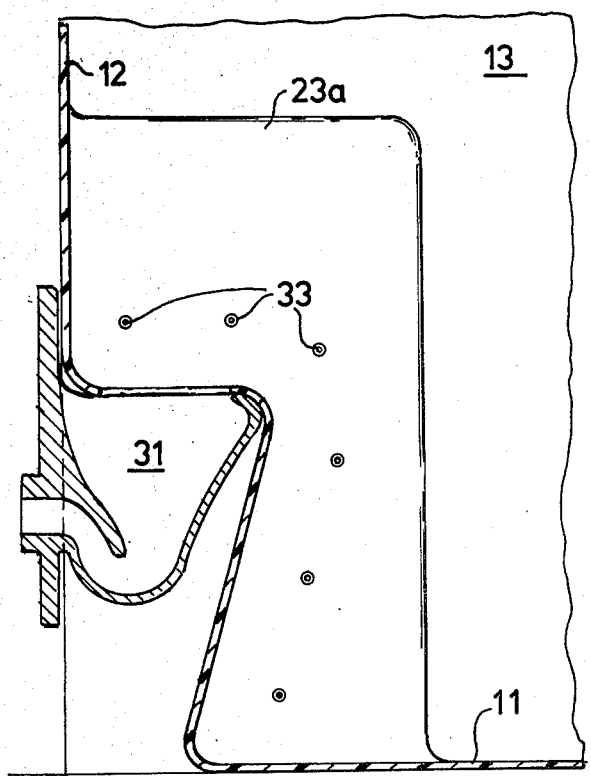
FIG. 5 is a fragmentary section on the line V—V of FIG. 2.

Referring to the drawings I have illustrated a modular rest room according to this invention in the form of a unitary watertight room having a top 10, a floor 11 and four sidewalls 12, 13, 14 and 15, one sidewall 15 having an entrance opening 16 and a sealing door 17. The floor 11 is generally sloped in all directions to a drain 18 which is large enough to permit passage of paper and like debris if necessary. A toilet 20 is provided in one corner, at the juncture of wall 12 and 13 and integral with and forming a part of those walls. A lavatory 21 and counter top 22 extend from toilet 20 along wall 13 to wall 14. The counter top 22 being formed as a unit with wall 13 and toilet 20 with arcuate contoured junctions of each wall and surface. The depending wall 23 from counter top 22 to the toilet seat is provided with a recessed paper holder 24 having sealing closure 25 which may be manually closeable or automatically closed as hereafter described. A like symmetrical wall 23*a* is formed on the opposite side of toilet 20 and forms the sidewall of a urinal or counter depending upon whether a man's or woman's unit is involved. A plurality of spaced nozzles 26 are fixed in walls 23 and 23*a* directed across the toilet 20. A similar plurality of spaced nozzles 27 are fixed in wall 14 and directed across the counter top 22 and the portion of wall 13 above the below the counter top. A water dispenser 28 is molded in wall 13 above lavatory 21 and is designed to deliver temperature regulated water into the lavatory 21 on a signal from a sensing device 29 such as a photo cell in the side of lavatory 21. A soap dispenser 30, similar to the water dispenser, is also molded in wall 13 above lavatory 21. A touch button actuator 30*a* located near the soap dispenser 30 activates a solenoid valve which releases a controlled amount of liquid soap from a reservoir 30*b* behind the wall.

A urinal 31 is formed integrally in and forms a part of wall 12 extending into wall 15 at the intersection of walls 12 and 15 and is separated from toilet 20 by vertical wall 23*a* integral with wall 12 and defined by wall 32 on the other side also integral with wall 12 generally transverse thereto. A plurality of nozzles 33 in walls 23*a* and 32 are directed across wall 12 above and below urinal 31.

A plurality of spaced nozzles 35 in ceiling or top 10 appropriately directed along each of the walls cleans each wall and a plurality of nozzles 36 in each wall directed across the floor cleans the floor.

The nozzles 26, 27, 33, 35 and 36 are connected to a system of pipes 40 on the rear side of the walls 12, 13 and 14 which pipes 40 are connected to a motor driven pump 41 preferably mounted on a base 42 which carries and forms a part of the rest room module. Pump 41 is preferably mounted under lavatory counter 22. Pump 41 is connected to a source of hot and cold water through valves 43 and 44. A tank 45 containing detergent is connected to pipe system 40 through valve 46. A sanitizing solution is contained in tank 47 and delivered to pipe system 40 through valve 48. Each of valves 43, 44, 46 and 48 are preferably solenoid controlled from a programmed cycling control system 50 designed to close closure 25 on paper container 24 and then properly cycle the sequencing of the valves to deliver the desired water temperature, detergent and sanitizing solutions through pipe system 40, and finally to actuate blower 51 and heater 52 to deliver drying fluid to the interior of the rest room.

Figure 6:
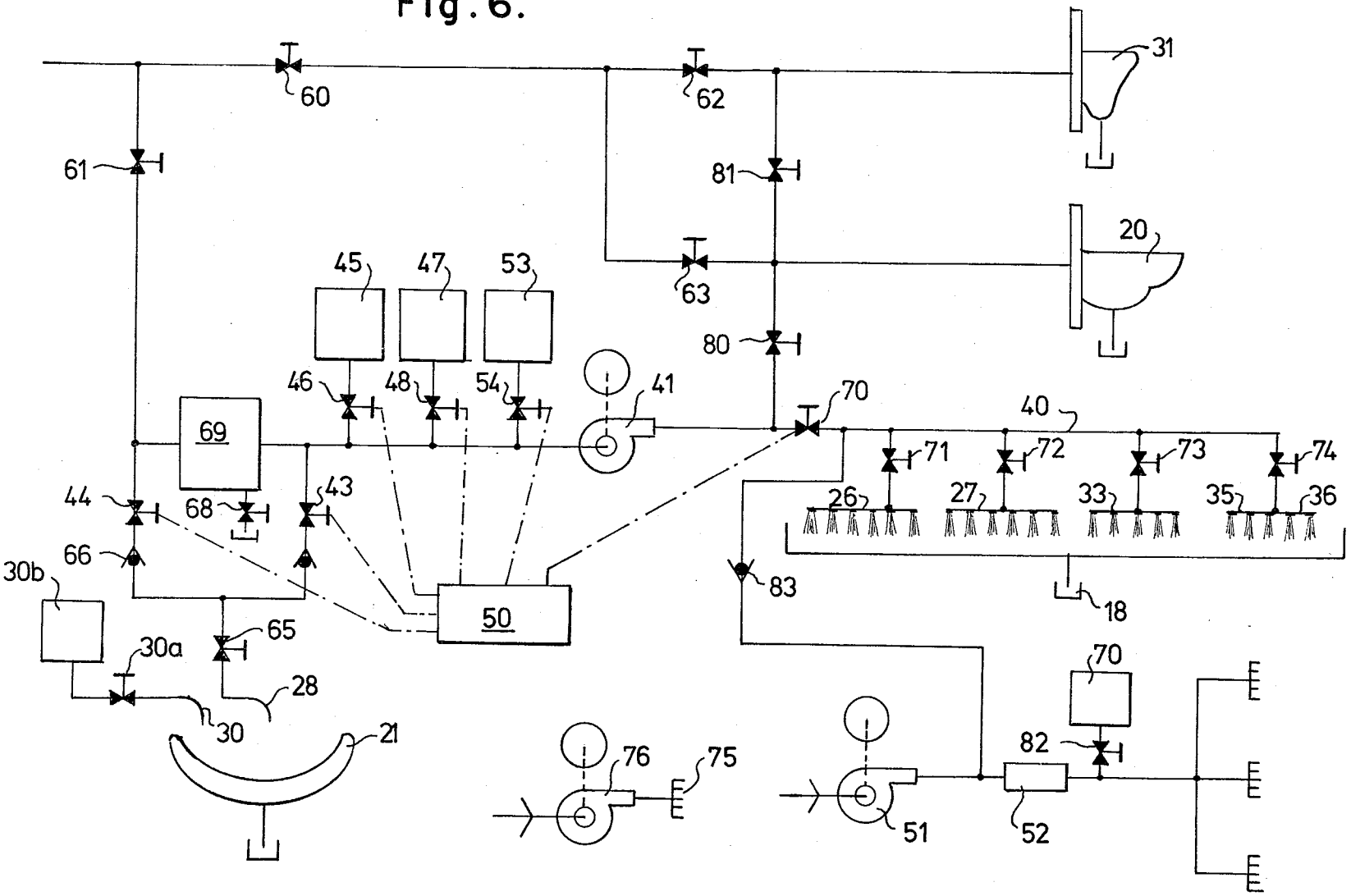
FIG. 6 is a schematic fluid systems arrangement for use with the modular rest room of this invention.

In FIG. 6 I have illustrated schematically the fluid systems used in this invention. A common water source is connected through two manual shutoff valves, 60 and 61, to the flush circuit and the cleaning circuit. 62 and 63 are solenoid operated flush valves, touch button actuated.

Valves 43 and 44 are manually operated proportioning valves to regulate the temperature of water dispensed to the lavatory through solenoid operated valve 65 (photo cell 29 actuated). Valves 66 and 67 are check valves and valve 68 is a manual drain valve on the water heater 69.

Solenoid valves 46, 48 and 54 are controller actuated to dispense detergent, disinfectant and wetting agent (from tank 53) into the cleaning fluid at appropriate times in the cleaning cycle. Solenoid valve 70 is the main cleaning system operating valve and solenoid valves 71, 72, 73 and 74 are used to properly sequence the cleaning process (the actual number of required sequencing valves has not yet been determined).

Solenoid valves 80 and 81 are used to permit the high pressure, high temperature cleaning fluid to be used to flush the toilet and urinal during the cleaning process, if desired.

30*a* is a touch button actuated solenoid valve used to dispense liquid soap.

Drying air for hand drying is introduced through lowered waterproof vent 75 from blower 76 actuated by pressing button 77.

Solenoid valve 82 is used to inject a small amount of deodorant from tank 70 into the interior of the rest room at the completion of the drying portion of the cleaning cycle. A small volume of drying air can be blown through check valve 83 to the washing nozzles for the purpose of eliminating drips.

The assembly of top, floor and walls described above is preferably pre-assembled as a module unit which can be set in place and connected to existing water and electrical connections.

The structure may also be built for manual cleaning by omitting the nozzles from the walls, in which event the interior may be quickly and thoroughly manually "hosed down" by an attendant utilizing either conventional cleaning apparatus or a portable high pressure, high temperature spraying system designed specifically for the purpose.

It should be noted that a feature of this invention is the absence of easily damaged appendages such as flush handles and water faucets. The toilet and urinal flush, soap dispenser, hand dryer and door lock and unlock are all actuated by recessed, sealed, solid state "touch buttons". Both the soap and water dispensers are contoured into the wall above the lavatory. The warm air hand dryer, spray nozzles, toilet paper holder, vents, light fixture and unbreakable mirror are recessed and sealed flush with the wall (ceiling) surfaces. This facilitates the cleaning process and additionally provides a vandal resistant structure.

In the foregoing specification I have set out certain preferred practices and embodiments of this invention, however, it will be understood that this invention may be otherwise embodied within the scope of the following claims.

I claim:

1. A readily sanitized public rest room module comprising a single formed unitary floor, ceiling, four walls and toilet fixtures, an entrance in one of said walls, a sealable closure for said entrance, a drain opening in said floor, lighting means sealingly recessed in one of said walls and ceiling, said toilet fixtures including a commode fixture positioned at the intersection between two of said walls and forming an integral unitary part thereof, and a lavatory and counter fixture on at least one wall adjacent said toilet and forming an integral unitary part of said wall, said wall and fixtures being a single integral unitary assembly free of joints with all intersecting surfaces being arcuately contoured and said floor being free of obstructions from wall to wall.

2. A rest room module as claimed in claim 1 having a urinal fixture on at least one wall and integral therewith.

3. A rest room module as claimed in claim 1 having a second counter on the other of said two walls and integral therewith on the opposite side of the toilet from the lavatory and counter fixture.

4. A rest room module as claimed in claim 2 or 3 wherein the rest room module is generally square in floor plan and the lavatory and counter fixture extend from the toilet fixture to an integral with a next adjacent wall and one of the urinal fixture and second counter extends from the toilet fixture to a next adjacent wall integral therewith opposite the lavatory and counter fixture.

5. A rest room module as claimed in claim 4 including a plurality of nozzles spaced apart vertically and horizontally directing a stream of cleaning fluid across each of said fixtures from adjacent walls, a pipe network on the opposite side of said wall from said fixture and high pressure, high temperature fluid delivery means connected to said pipe network, said adjacent walls being so formed that said pipe network and delivery means are enclosed all within said square floor plan.

6. A rest room module as claimed in claim 5 including a source of detergent and a source of sanitizer and a source of wetting agent connected to said pipe network and means interposed between each of said sources and the pipe network sequentially delivering detergent, sanitizer and wetting agent thereto.

* * * * *